US006474276B1

(12) United States Patent
Schmitz et al.

(10) Patent No.: US 6,474,276 B1
(45) Date of Patent: Nov. 5, 2002

(54) METHOD FOR CONTROLLING AN ELECTROMAGNETIC VALVE DRIVE MECHANISM FOR A GAS EXCHANGE VALVE IN AN INTERNAL COMBUSTION PISTON ENGINE

(75) Inventors: Günter Schmitz; Christian Boie, both of Aachen; Frank Van Der Staay; Lutz Kather, both of Würselen, all of (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 09/743,677

(22) PCT Filed: May 17, 2000

(86) PCT No.: PCT/EP00/04463

§ 371 (c)(1),
(2), (4) Date: Mar. 14, 2001

(87) PCT Pub. No.: WO00/71861

PCT Pub. Date: Nov. 30, 2000

(30) Foreign Application Priority Data

May 19, 1999 (DE) ..... 199 22 970

(51) Int. Cl.[7] ..... F01L 9/04
(52) U.S. Cl. ..... 123/90.11; 251/129.01
(58) Field of Search ..... 123/90.11; F01L 9/04

(56) References Cited

U.S. PATENT DOCUMENTS 3,896,346 A 7/1975 Ule
5,775,276 A * 7/1998 Yanai et al. ..... 123/90.11
6,016,778 A * 1/2000 Koch ..... 123/90.11

FOREIGN PATENT DOCUMENTS

| | | |
|---|---|---|
| DE | 195 29 155 | 2/1997 |
| DE | 195 30 121 | 2/1997 |
| DE | 197 23 405 | 12/1998 |
| DE | 197 33 106 | 2/1999 |
| DE | 197 39 840 | 3/1999 |
| DE | 198 47 851 | 4/1999 |
| EP | 0 281 192 | 9/1988 |
| EP | 0 727 566 | 8/1996 |

* cited by examiner

*Primary Examiner*—Thomas Denion
*Assistant Examiner*—Sean O'Brien
(74) *Attorney, Agent, or Firm*—Venable; Norman N. Kunitz

(57) ABSTRACT

A method for controlling an electromagnetic actuator for a cylinder valve in a piston-type internal combustion engine with the actuator being operatively connected to the cylinder valve and moveable back and forth between two electromagnetics, counter to the force of at least one restoring spring. The current supplied to the electromagnetics is controlled with the aid of a sensor arrangement and via an engine control unit such that the current supply to the catching electromagnet, i.e., the electromagnet being approached by the moveable armature of the actuator, is controlled so as to move the armature slowly toward the respective pole face. Moreover, in order to regulate the valve play during the closing movement of a cylinder valve, the current supply to the catching electromagnet is controlled such that the valve initially touches down softly on its seat and that following the valve play, the armature touches down softly on the pole face.

15 Claims, 12 Drawing Sheets

METHOD FOR CONTROLLING AN ELECTROMAGNETIC VALVE DRIVE MECHANISM FOR A GAS EXCHANGE VALVE IN AN INTERNAL COMBUSTION PISTON ENGINE

BACKGROUND OF THE INVENTION

A major problem with electromagnetic valve drives for operating a cylinder valve in a piston-type internal combustion engine is that in the presence of a valve play, the valve touchdown speed must be controlled so as to reach extremely low values (below 0.2 m/s). This is due to the fact that relative to the armature distance, the valve touchdown point changes for thermal reasons (variation of the valve play) during the operation. The armature furthermore must still safely reach the pole face after the valve has touched down. If the current supply is too low, the armature reverses direction too early and knocks the valve off again. If the current supplied is too high, the resulting armature touchdown speeds- are too high, which leads to an acoustic problem as well as rebounding actions and, in the worst case, also to a renewed, uncontrolled valve opening and thus a failure of the complete system.

The invention is explained in further detail with the aid of schematic drawings.

DESCRIPTION OF THE PREFERRED EMBODIMENT

Figure 1:
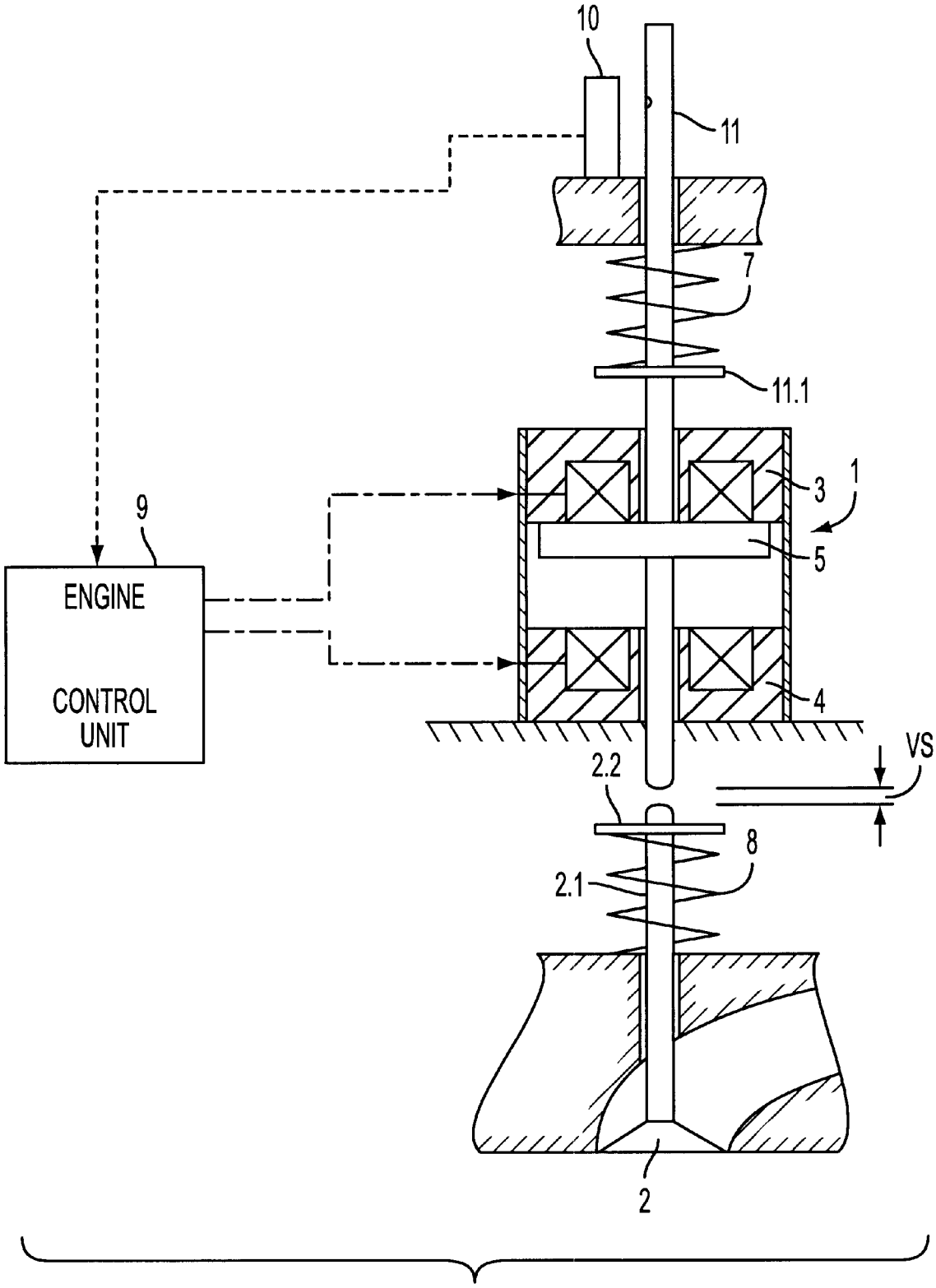
FIG. 1 is a schematic illustration of an electromagnetic valve drive with control.

The basic principle of an electro magnetic valve drive of this type, including its control, is shown schematically in FIG. 1.

An electromagnetic valve drive for actuating a cylinder valve 2 essentially comprises an actuator 1 with a closing magnet 3 and an opening magnet 4, which are arranged at a distance to each other. An armature 5 can be moved back and forth between these magnets, counter to the force of a readjusting spring, namely an opening spring 7 and a closing spring 8.

The "traditional" arrangement for the opening spring and the closing spring is shown in FIG. 1 in the closed position. With this arrangement, the closing spring 8 is directly effective by means of a spring plate 2.2 that is connected to the shaft 2.1 of the cylinder valve 2. The guide rod 11 of the electromagnetic actuator is separated from the shaft 2.1. As a rule, a gap in the form of the so-called valve play VS exists in the closed position. The opening spring 7 in turn supports itself on a spring plate 11.1 on the guide rod 11, so that in the center position where no current is supplied to the magnets, the guide rod 11 supports itself on the shaft 2.1 of cylinder valve 2 while the opening spring 7 and the closing spring 8 are effective in opposite directions. It is also possible to provide a single return spring in place of the opening spring 7, which is designed to build up a corresponding restoring force each time the armature 5 passes over the center position. A separate closing spring 8 is therefore not needed. With an arrangement of this type, however, the guide rod 11 must be connected to the shaft 2.1 of the cylinder valve by means of a corresponding coupling element, which transmits the back and forth movement of the armature in the same way to the cylinder valve 2, but which nevertheless permits a valve play.

The electromagnets 3 and 4 of actuator 1 are actuated via an electronic engine control 9, in accordance with the predetermined control programs and in dependence on the operating data such as speed, temperature, etc., which are supplied to the engine control.

The actuator 1 is assigned a sensor 10, which makes it possible to detect the actuator functions. The sensor 10 is shown schematically herein. Depending on the sensor design, it is possible to detect the path traveled by the armature 5, for example, so that the respective armature position can be transmitted to the engine control 9. If necessary, the armature speed can be determined with the aid of respective computations in the engine control 9, so that the current supply to the two electromagnets 3, 4 can be controlled in dependence on the armature position and/or in dependence on the armature speed.

It is not necessary for the sensor 10 to be arranged on the side of the extended guide rod 11, as shown. Rather, it is also possible for corresponding sensors to be arranged in the pole face region of the respective electromagnet, or on the side of the armature 5.

The engine control 9 furthermore comprises means for detecting the current and the voltage for the respective electromagnet 3 and 4, as well as for changing the current curve and the voltage curve. The actuator 1 of cylinder valve 2 can be actuated fully variable via the engine control 9, for example with respect to start and end of the opening times, in dependence on preset operating programs, if necessary supported by corresponding performance characteristics. An actuation with respect to the height of the opening stroke or even the number of opening strokes during a closing time is possible as well.

A current control requiring data on the actual movement or position of the armature as input signal is necessary to achieve low touchdown speeds for the armature 5. As long as no valve play exists, a control based on the armature position is sufficient. However, if a valve play exists, the situation is rather problematic on the closing side. The armature speed and thus also the valve speed must already have a very low value of approximately 0.2 m/s or lower when the valve touches down on the valve seat (must be at least in the low-speed range).

Figure 2:
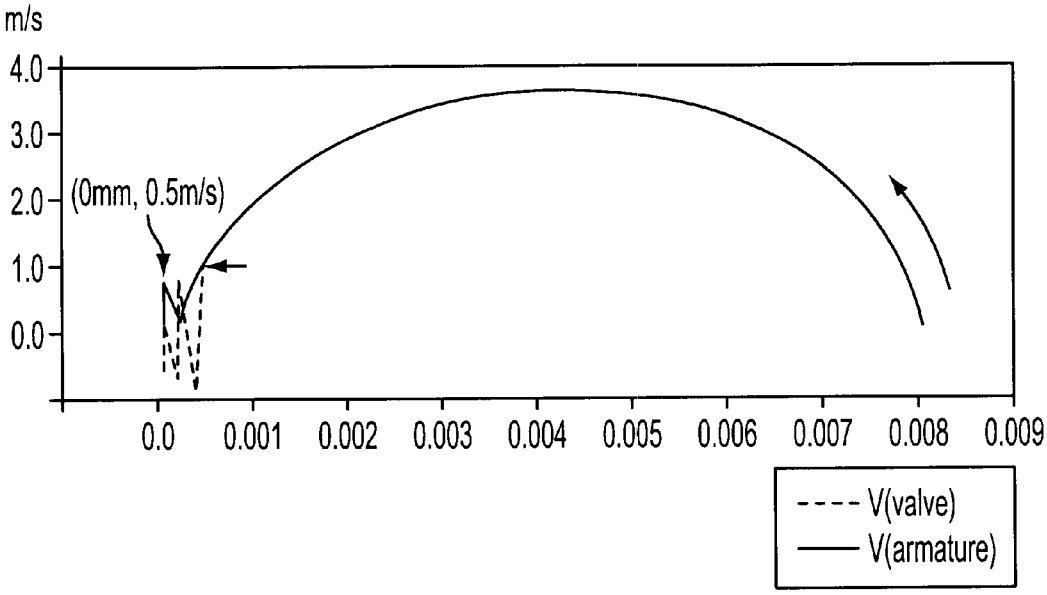
FIG. 2 shows the speed curves for armature and valve during a closing movement.

In FIG. 2, the situation is demonstrated for a "normal" valve touchdown, meaning without the use of the method according to the invention. The armature speed over the path traveled by the armature is shown as a drawn-out line. The position for the opened case is shown on the extreme right. An armature stroke of 8 mm was selected here as example. The armature position when the armature rests against the pole face of the closing magnet is shown on the extreme left at 0, 0. Thus, a closing movement starts at the extreme right position of the picture, at 8 mm and a speed of 0. The speed then increases until approximately the center position between the pole faces is reached (at approximately 4 mm). If the armature is operated "normally" (not controlled), the valve still arrives at the valve seat with a relatively high speed of approximately 1.1 m/s, particularly if there is a noticeable valve play of, for example, 0.4 mm (cold 0 engine). In this position, the armature movement is separated from the valve movement. The valve is stopped abruptly (interrupted line) and the speed drops to below zero, meaning the valve rebounds.

The armature initially slows down, but its speed increases once more shortly before touchdown and the armature touches down with a speed of approximately 0.5 m/s. In the meantime, the armature speed has dropped to nearly zero. With a further reduction in the catching current level, the armature would reverse directions before reaching the pole face and the system would fail.

Figure 3:
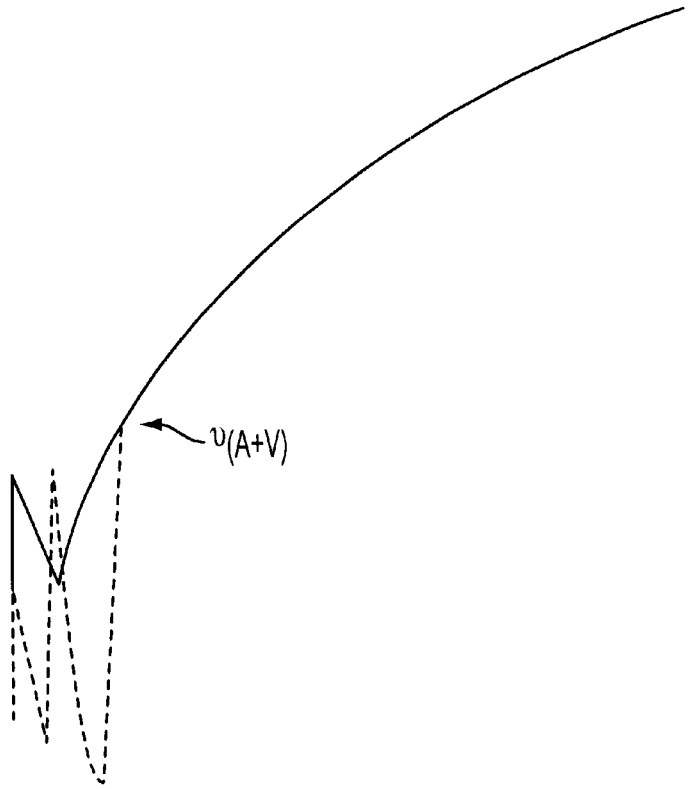
FIG. 3 shows the speed curves for armature and valve when reaching the closed position on a larger scale.

The region where the valve and the armature touch down is shown enlarged in FIG. 3. The separate armature and valve movements are clearly recognizable. Initially, the armature and valve move together without valve play (curve segment $v_{a+v}$). As soon as the valve touches down on its seat, valve and armature separate and perform separate movements owing to the valve play. (The dashed line is for the valve; the drawn-out line is for the armature.)

Figure 4:
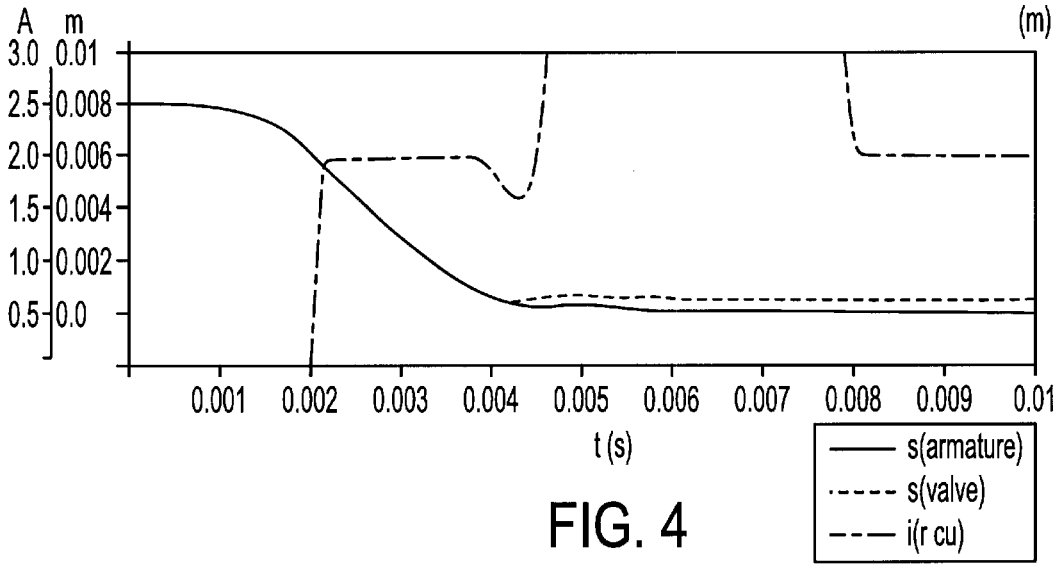
FIG. 4 illustrates the curves for the valve path and the armature path as well as the current curve in dependence on the time when using a state-of-the-art control.

The curves for the armature position (drawn-out line), the valve position (dashed line) and the current (dash-dot line) are plotted above the time in FIG. 4. Initially, the current level shows that a constant current value is maintained. However, the current initially collapses if the armature is getting very close since the counter-induced voltage exceeds the supply voltage. Following this, the preset value for the current level is raised to ensure a secure catching of the armature. The new level can be reached because the armature is almost at a standstill and because the lack of armature movement initially does not induce an additional counter-voltage.

Figure 5:
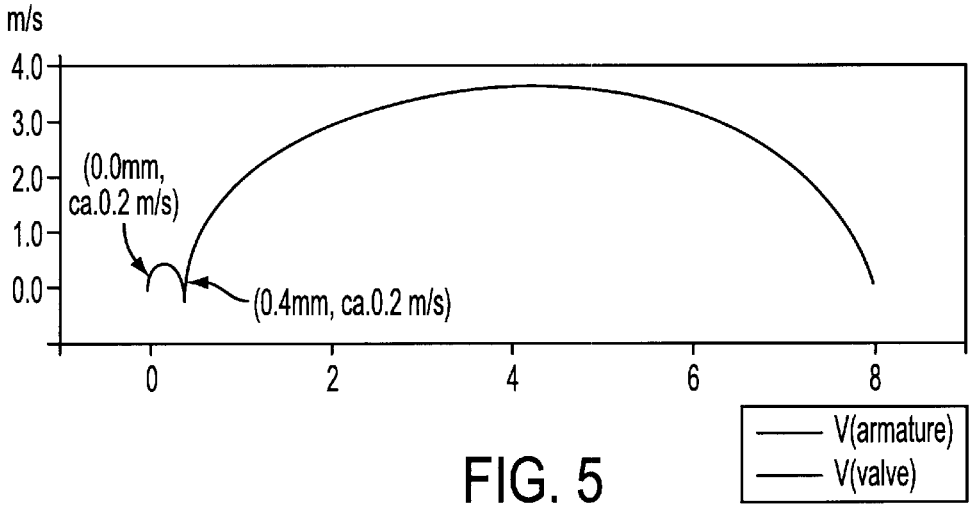
FIG. 5 shows the speed curves for valve and armature during the closing movement for a control based on the method according to our invention.
Figure 6:
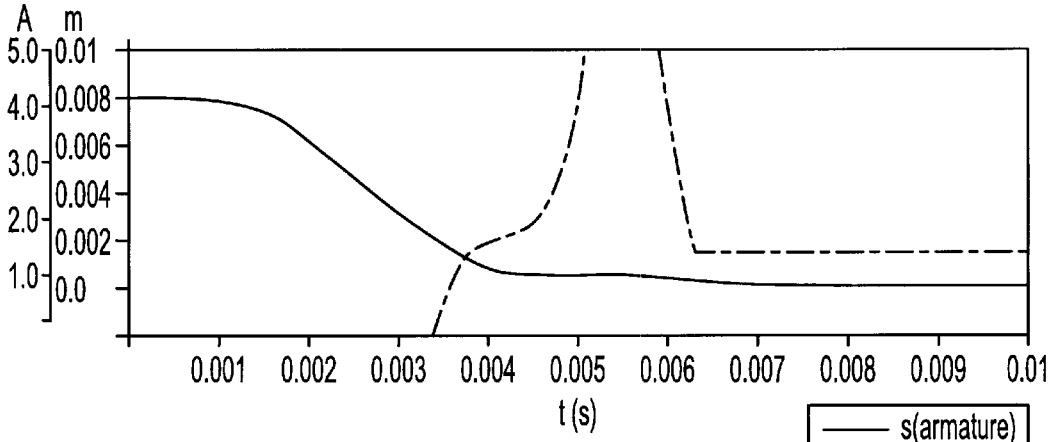
FIG. 6 shows the curves for the armature path and the current in dependence on the time when using the method according to the invention.

FIGS. 5 and 6 show the conditions when using the method according to the invention for the exemplary embodiment illustrated in FIGS. 2 and 4. The speed curve over the path traveled by the armature, in turn, is shown in FIG. 5. The curve for the armature speed differs significantly from the uncontrolled curve. Initially, the armature is accelerated more following the separation from the valve than in the unregulated/uncontrolled case. With a closer approach, however, the current is drastically reduced again to the level required for stopping the armature (approximately 1.5 A for this example).

With a corresponding design of armature and yoke, it may even make sense to supply current flowing in the opposite direction (reversal of current direction) to produce rejecting forces.

The armature path curve and the current curve are plotted over the time in FIG. 6. A valve touchdown speed of approximately 0.2 m/s can be achieved as a result of controlling the current curve.

Figure 7:
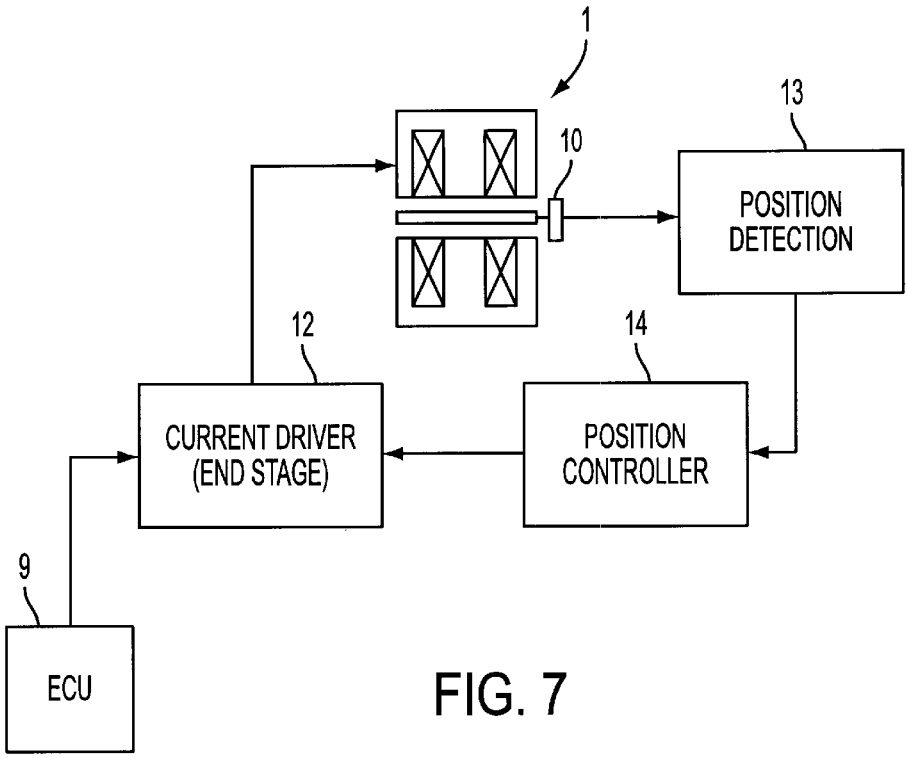
FIG. 7 is a schematic illustration of the basic layout of the control in the form of a block diagram.

The block diagram in FIG. 7 shows the actuation by the actuator. The engine control 9 in this case predetermines the point in time at which the movement (valve closing) is initiated. This occurs through shutting down the current with the closing coil in the current driver 12 (the example shows that no current is supplied to the closing coil). Depending on the respective armature position, which is determined via a position detection device 13, for example a sensor 10 plus processing circuit, the current is then controlled in such a way that the armature maintains, if possible, a path/speed profile that can be predetermined. The position controller 14 is used for this.

Figure 8:
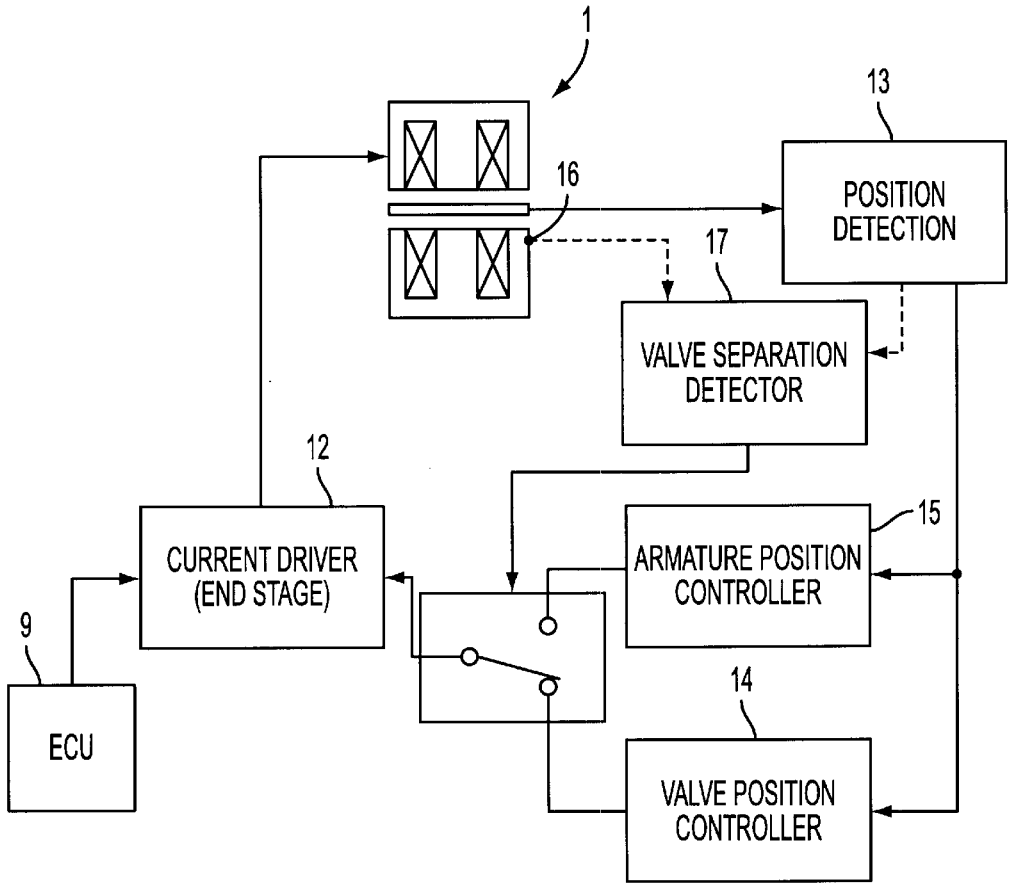
FIG. 8 is a schematic illustration of the sequence of steps for the actuation method according to the invention, shown with the aid of a block diagram.

FIG. 8 shows that two control or regulation operations are planned. During the movement of the cylinder valve, the control is initially assumed by the unit designated the valve position controller 14. The design for this unit can be identical to that for unit 14 in FIG. 7. However, it must be taken into consideration that the target, which must be reached with low speed, is not the pole face, but rather the valve seat, that is to say the pole face position plus the valve play.

As soon as the seating of the valve in the seat is detected (or that the valve is immediately adjacent to it), a switch to the armature control occurs. This is illustrated in FIG. 8 in that a "valve separation detector" 17 determines that the valve has touched down on the seat and the current presetting device for the current driver 12 then switches to the output of the armature position controller 15. (In reality, the armature position controller can physically be the same unit, which is simply controlled in another mode.) The valve separation detector can obtain its information from the sensor 10 or the position detector or the output signal of the position detection 13. Based on the current and/or voltage curve on the magnet, it can draw a conclusion for the separation of valve and armature or determine this via a separate sensor 16. A sensor of this type can simply be a contact that closes when the two electrically conductive parts separate (e.g. armature bolt and valve shaft). In order to avoid problems with dirt on the contacts, however, it is also possible to detect a capacity change between the separating components. A non-conductive separating layer is required for this between the two components.

The armature current controller can also perform its function via a time control since only the distance of the valve play must still be bridged. For example, the current curve in this case is plotted above the time and in dependence on the existing valve play. Thus, it also becomes possible to use a valve position sensor in place of the armature position sensor since the information on the armature position is no longer that important.

Figure 9:
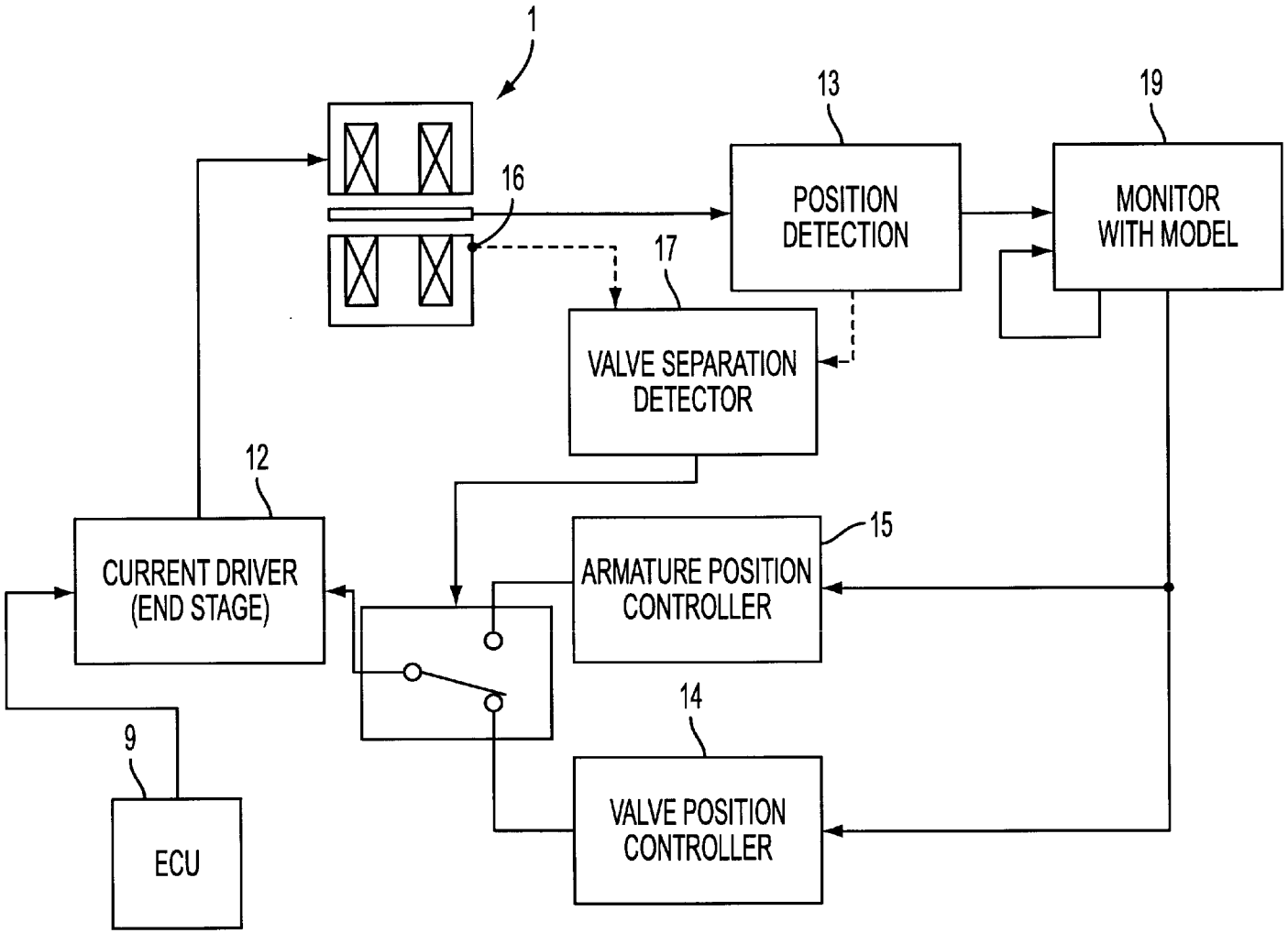
FIG. 9 is the the block diagram according to FIG. 8, supplemented with a "monitor."

FIG. 9 shows an expanded control that is particularly useful if the position is to be detected with cheap sensors. The problem in that case is that the path signal must be differentiated in order to obtain a speed information. However, with a noisy or interrupted signal this can be achieved only insufficiently. The problem can be remedied with a monitor 19 containing a model of the actuator (e.g. in the form of differential equations for the connection between acceleration, speed and armature position, as well as information on the armature and valve mass, the spring forces, etc.). Finally, the speed curve that is possible in principle can be anticipated within limits by the system. The model can then be initialized at the start of the movement. The exact position and the speed are known at that point in time. The new information on the measured position 13 as well as the variable values for the condition determined by the model, if necessary, flow into the monitor (into the model) as new input variables and can then be used to correct the actual output variables for path and speed. Furthermore, a self-calibration (adaptation) of the model in the monitor can take place. For example, if the monitor determines that the friction is higher than provided so far for the model, new parameters for the corresponding variable can be set automatically.

Figure 10:
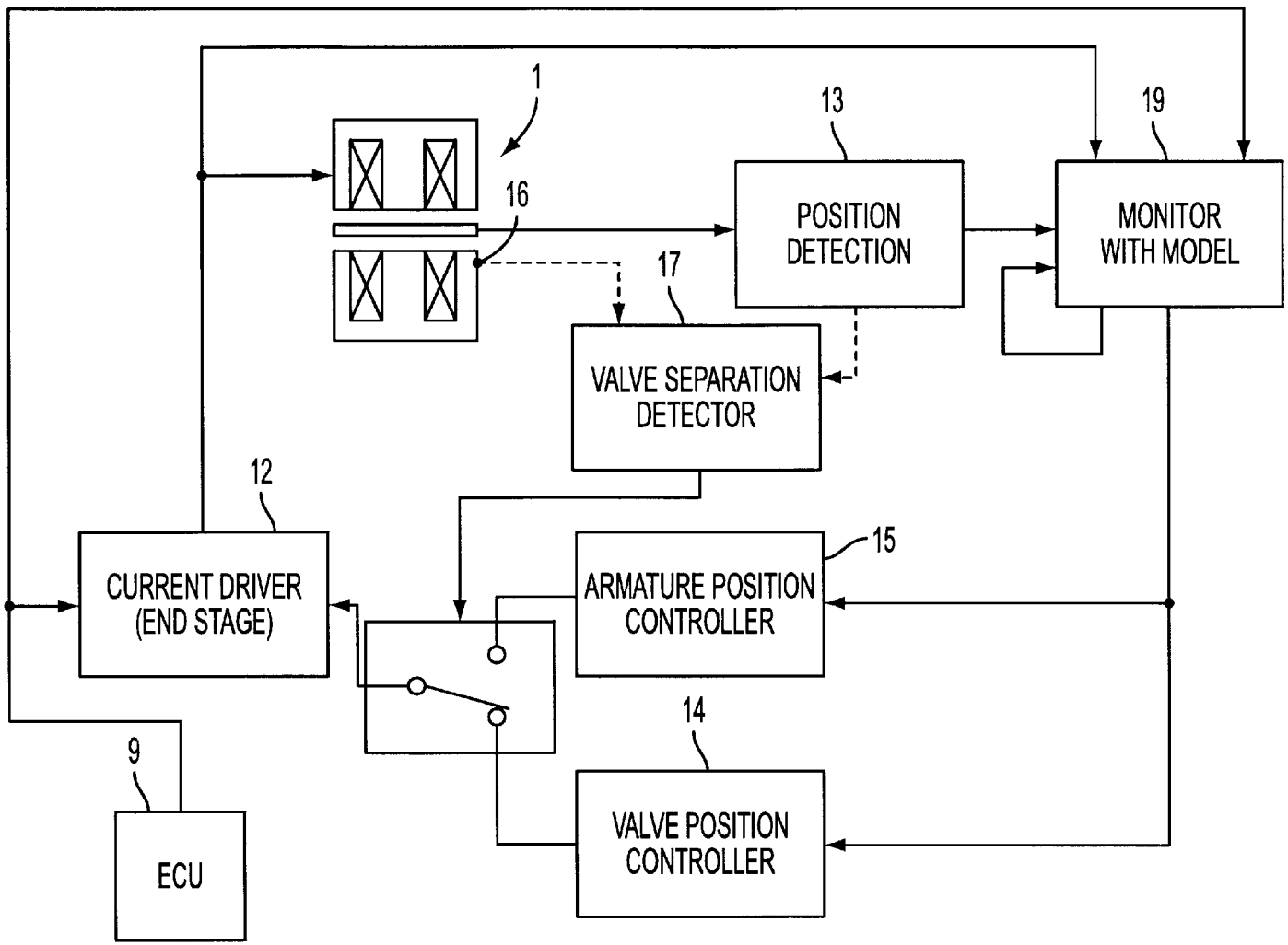
FIG. 10 is the block diagram according to FIG. 9 with a link between the engine control and the monitor.

Also, specific parameters for improving the parameter-setting of the model by the engine control, for example depending on the load (gas forces at the outlet valve), or the engine temperature (estimation of valve play, friction, etc.) can be fed into the model (see also FIG. 10, the connection between 11 and 19).

In addition to setting up a purely mechanical model, it is also possible to take into account the magnetic forces as well. This requires knowledge of the actually existing current supply, as shown in FIG. 6 (connection from 12 to 19 in FIG. 10).

Figure 11:
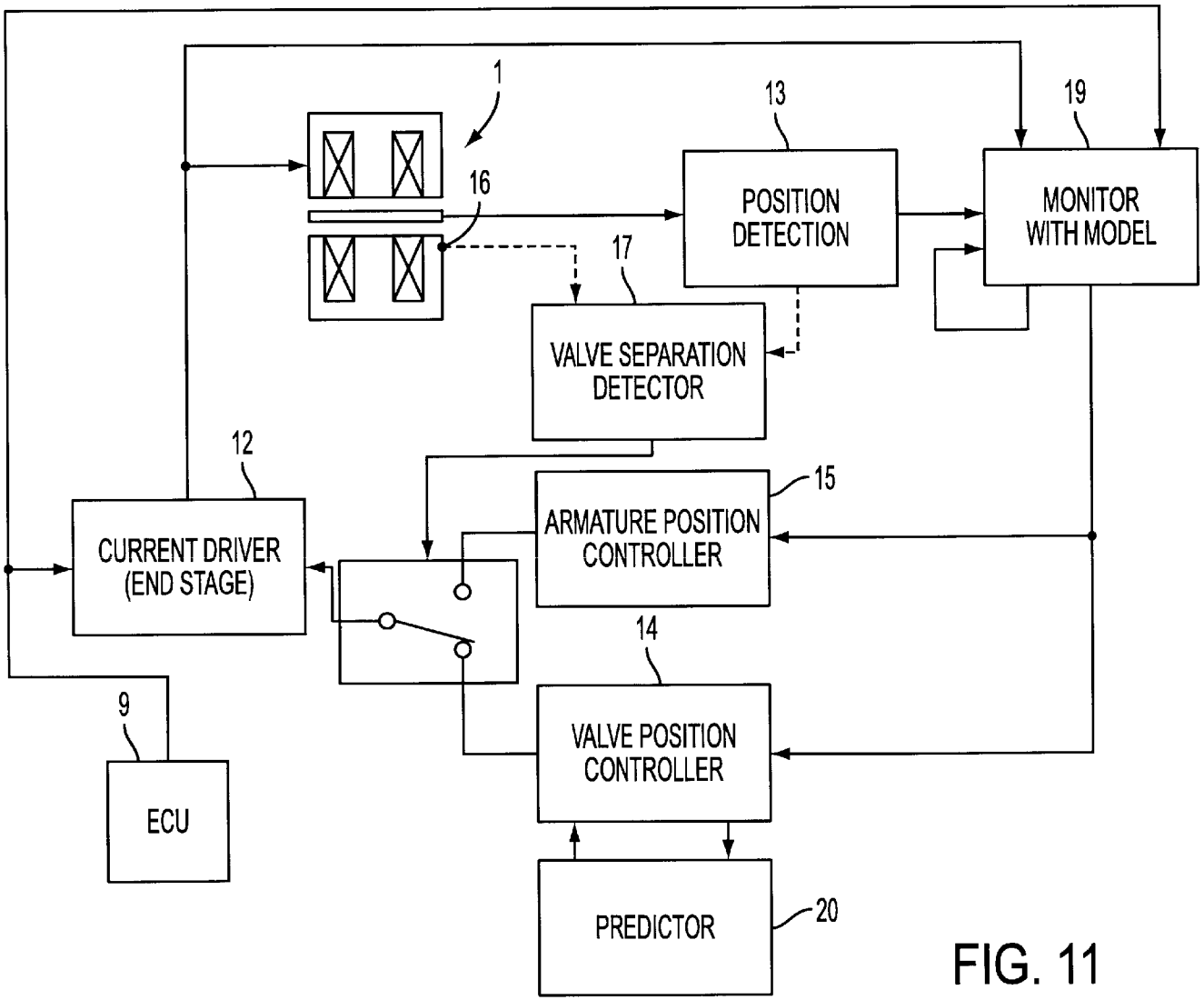
FIG. 11 is the block diagram according to FIG. 10, supplemented by a pre-estimation unit.

The quality of the controller itself can also be improved if it can be estimated ahead of time how the introduced measures (change of current level) will influence the armature. For this, a predictor 20, a "pre-estimation unit," is made available to the controller 14 in accordance with FIG. 11. The predictor 20 furthermore contains a system model and is therefore able to assess the effects of these measures. If the measures are considered not sufficient or too strong, the controller can also be corrected ("called back").

The predictor 20 can furthermore also have an "intelligent" design, so that it can adapt automatically to changing model parameters.

Particular attention must be paid to providing a cost-effective design as well as to ensure the highest possible precision when detecting the armature or valve position. In particular during the last approach phase where the speed is already relatively low and the path information must be very exact, the resolution limit for a possibly required analog/digital conversion (quantization) can present a problem. This resolution can be improved in that prior to the conversion, the respectively actually estimated value for the position (e.g. from the monitor 19) is initially deducted from the value detected by the sensor, meaning before the value is digitized. FIG. 12 shows the return 21 of the position signal from the monitor 19 to the position detection 13.

Figure 12A:
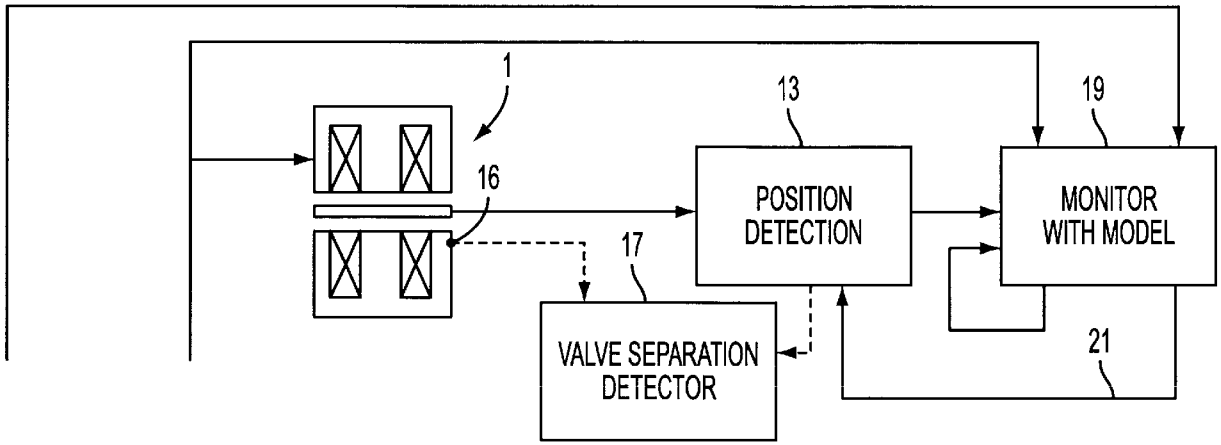
FIGS. 12A and 12B are block circuit diagrams showing circuit modifications when using a "monitor."

FIG. 12A shows an example of an embodiment for the position detection. The return signal 21, which is made available in digital form by the monitor, is supplied to a D/A converter 22. The output of the D/A converter 22 thus supplies in an analog form the value determined by the monitor for the position. With the aid of a subtracter 24, this value is subtracted from the signal provided by a position sensor, which is initially raised to the correct level by a processing circuit 23. Following the subtracter, only the difference to the position presently determined by the monitor is available. The signal range for this signal is naturally considerably smaller than that for the original position signal. Thus, its level can be raised with the aid of an amplifier 25 prior to the A/D conversion 26. The A/D converter subsequently supplies the signal for the difference detected by the monitor between the path information and the current, new path information in a digital form to the monitor 19. This monitor, if necessary, can obtain the new position information by adding the previously detected signal 21 and the new difference information.

Figure 12B:
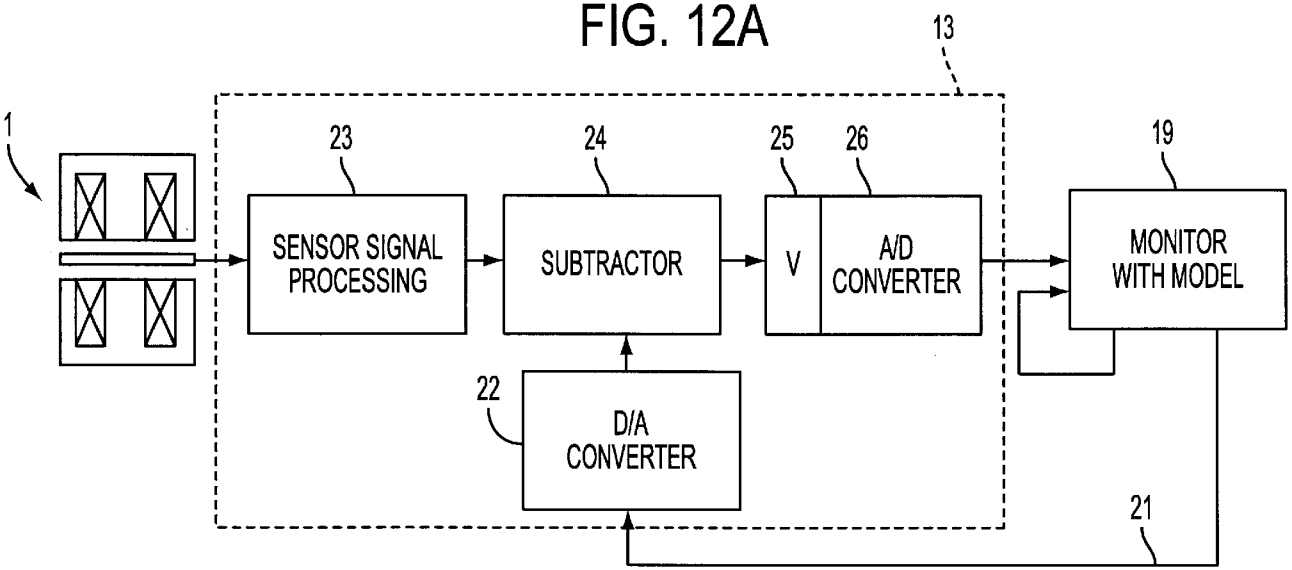

Other exemplary embodiments are possible as well. For example, the A/D converter and/or the D/A converter can be integrated into the monitor (FIG. 12B).

According to the invention, the position and/or the speed of the armature is measured continuously with a sensor in order to control a soft touchdown and these values are used for a closed-loop control of the actuator. The invention proceeds on the assumption that an effective closed-loop control of the armature speed or the valve speed is possible only during the last portion of the movement, meaning shortly before reaching the respective end position, because of the dynamic characteristics of the system. Nevertheless, it is necessary to intervene at an earlier point in time to be able to reach the required current level. The invention provides that parameters are determined during the first portion of the movement, which parameters are correlated with the cylinder inside pressure. The method of the smallest error square rate is used for this by looking at the trajectory v(s) in the status space (v=speed; s=position). Depending on the parameter values, the voltage is set to a constant level once a specific path position $s_1$ is reached. Once an equilibrium of forces (dv/dt=0) is reached, a nonlinear controller is preferably activated, which switches the voltage on or off, depending on the deviation (v–v(s)) of the measured speed for a desired curve v(s). In accordance with the invention, energy is fed with low loss and via a bridge circuit back into the vehicle onboard system once the voltage is switched off, meaning the respective coil is operated with the supply voltage. A particularly effective closed-loop control according to the invention is possible as a result of the speed at which the current drops once it is switched off.

For one preferred arrangement, the requirement dv/dt=0 is detected directly through a derivation and filtering of the path signal.

The requirement dv/dt=0 for another preferred arrangement is replaced by the requirement $I>=I_{max}$, meaning the voltage is shut down and the controller activated once a predetermined current level $I_{max}$ is reached.

The switch-on position $S_{on}$ and the current threshold $I_{max}$ for one preferred arrangement are expressed in dependence on the supply voltage that is measured and the parameters, which reflect the pressure inside the cylinder. This can occur either through a functional connection or a performance characteristic.

The desired curve v(s) for one preferred arrangement is selected to be flat during the last portion of the movement, so that the control can ensure a low touchdown speed, even with sensor errors.

For one preferred arrangement, the desired curve v(s) is for speeds lower than 0.3 m/s since the response time of the control in that case is short enough to realize a closed-loop control, relative to the system idle time.

The flat desired curve of one preferred arrangement is expanded enough, so that the area of valve play can be bridged and so that valve and armature can touch down at a low speed.

The valve play of one preferred arrangement is measured during the first part of the opening phase of the valve in that the abrupt drop in the armature speed is measured during the impact with the valve. The expansion of the slow movement segment can thus be adapted to the actual valve play.

The spring-mass-system of one preferred arrangement can be designed such that the distance from the earliest possible point of reaching an equilibrium of forces to the end position on the opening and closing side is long enough to bridge the valve play and compensate for sensor errors. For this, an armature with low eddy currents is preferably used, for example made of a sintered material, to increase the range by lowering the maximum required current level for the equilibrium of forces.

To increase the low-speed range for the path just prior to the end position, the holding magnet is briefly supplied with current. Thus, a low maximum speed is reached and the earliest point on the path curve, for which a force equilibrium can be achieved, is further removed from the end position. For one preferred arrangement, the energy tapped mechanically in the process is fed back electrically by using an armature with low eddy currents and a corresponding clocking stage, preferably in a bridge circuit.

The sensor used for one preferred embodiment is a digital path sensor.

The raw sensor signals of one preferred embodiment are processed with the aid of a status monitor, such that the quality of the path/speed signal and the current signal is improved by using information on the system behavior of the actuator. The status monitor of a particularly preferred arrangement uses the parameters measured during the initial phase of the movement, meaning during the armature release, which are correlated to the counter pressure. For one particularly preferred arrangement, a mean value is formed for the sensor signal during the phase when the armature makes contact in one of the end positions, with the goal of compensating a possibly existing offset error and/or amplification error of the sensor and thus reduce the requirements for the sensor with respect to the temperature stability.

The controller for a particularly preferred arrangement is a two-point or a three-point controller with feedback branch, which contains a digital filter. This filter is preferably a low-pass filter with a suitably matched characteristic. The scanning time for the complete arrangement is preferably at 20 $\mu$s.

The end phase of one particularly preferred arrangement is a switching end stage, for which the rise times and the decay times fall below 5 $\mu$s.

In one preferred arrangement, the communication between the touchdown control of the actuator and the actuating engine control is designed in such a way that the engine control delivers information on the expected cylinder inside pressure, which are used in addition to the measured parameters and which are correlated to the actual cylinder inside pressure. The touchdown control furthermore supplies information back to the engine control, for example the measured valve play, parameters that are correlated to the actual cylinder inside pressure, parameters correlated to the actuator wear and parameters correlated to the actuator temperature.

In another preferred embodiment, the invention is used if the valve play is compensated hydraulically. Advantageous in that case is a strong damping of the vibrations in the speed/path curve, which normally occur when the armature bolt impacts with the valve and a valve play is present. The valve play makes it more difficult to determine parameters that are correlated with the counter pressure.

The information quality must meet high requirements during the actuator control, particularly for the realization of the method according to the invention. The requirements for resolution, reproducibility and accuracy are above the requirements met by standard analog sensors, which are presently used in this application field. The reason for this, among other things, is that the concentration of electrical stray fields directly adjacent to the engine is immense and that the interference level absorbed by the lines is very high.

A digital signal transfer therefore represents a possible solution to reaching the desired quality.

Another advantage can be achieved if the measured signal is obtained directly with the aid of a digital measuring operation. The advantages in this case are: no A/D conversion, cheap and robust electronic components, etc.

Some of the principles presented here are based on digital measuring methods. For this, a digital pulse is issued for each path or a binary bit pattern for each path segment. With the relative position determination, the absolute position must be derived with the aid of an algorithm and by taking into account the rest position and the maximum path traveled by the armature. The speed can be determined via the time difference between the pulses or the bit pattern changes.

Preferred measuring methods are those, which can be realized as integrated components, including the signal processing.

Digital methods for a relative position measurement are:

- optical methods with slotted disk;
- optical methods based on the interferometer principle, as described in the following;
- magnetic methods, using a magneto-resistive matrix without binary coding, as described in the following;
- resonator measuring principles (frequency depending on the geometric position of the armature path), as described in the following.

Absolute measuring principles, which sensibly result in a binary code corresponding to the position:

- optical methods with, for example, a charge-coupled device CCD line,
- magnetic method with a magneto-resistive matrix, configured one-dimensional or two-dimensional, in contrast to singular magneto-resistive sensors, which are known.

Figure 13:
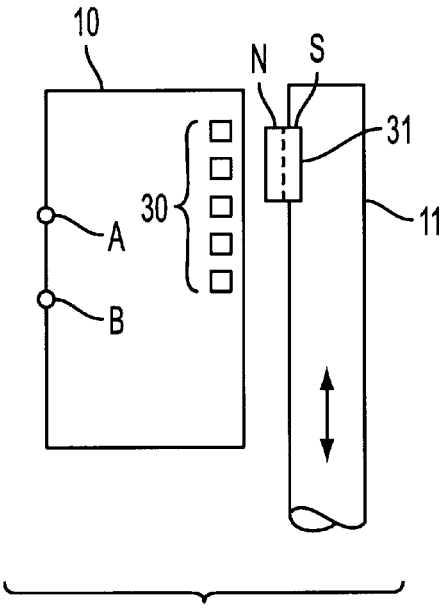
FIGS. 13 to 15 illustrate the design and function of a magneto-resistive movement sensor.
Figure 14:
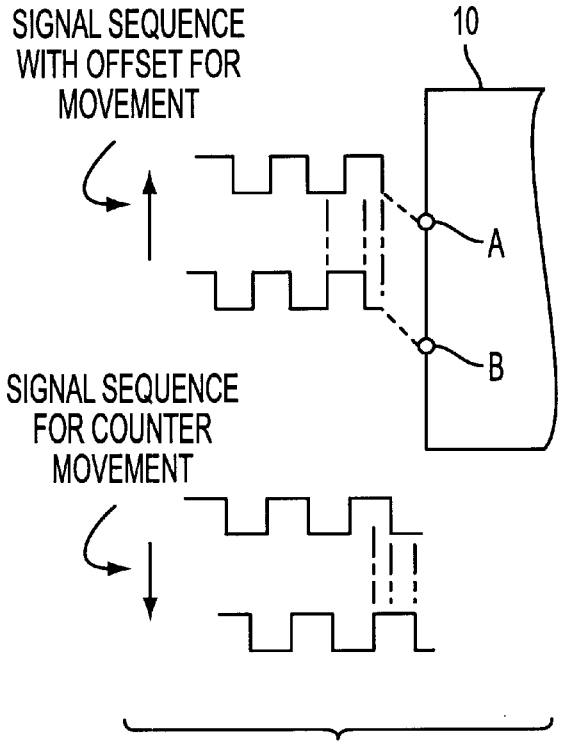

FIGS. 13 to 17 show and describe a path measurement using a magneto-resistive measuring principle on the basis of measuring cell matrixes. The magneto-resistive matrix 30 (XMR matrix) can be arranged as shown in FIGS. 13 and 14. A position magnet 31 is attached to the guide rod I 1. The evaluation circuit for the XMR matrix 30 provides the information which sensor of the matrix for the sensor line receives a maximum signal. That is the position with which the position magnet 31 is correlated on the guide rod 11, meaning the actual path position.

Figure 15:
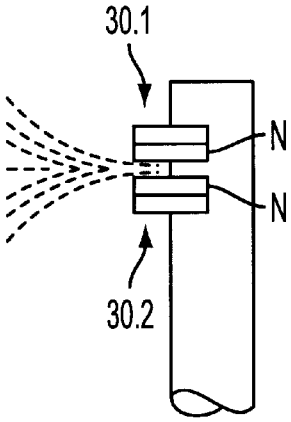

FIG. 14 shows another embodiment. The signal processing is limited to generating pulses during the change of the maximum from one single sensor to the next one. One preferred embodiment concerns the generating of a pulse code that is displaced by 90° for the direction detection. An embodiment with special magnet geometry, for example the embodiment shown in FIG. 15, is suitable for increasing the resolution. Through the arrangement of two position magnets 30.1 and 30.2, a narrow region with horizontally extending field lines is created in the center, which permits a larger path between matrix and position magnet.

Another option for increasing the resolution is the use of the Nonius principle. For this, several position magnets are mounted on the guide rod 11.

A compensation of mechanical tolerances relative to the rotational geometry of the guide rod is possible through an evaluation and by taking into account the level distribution.

The accuracy for compensating mechanical tolerances can conceivably be increased further through a special arrangement of two matrixes, for example arranged opposite each other.

Figure 16:
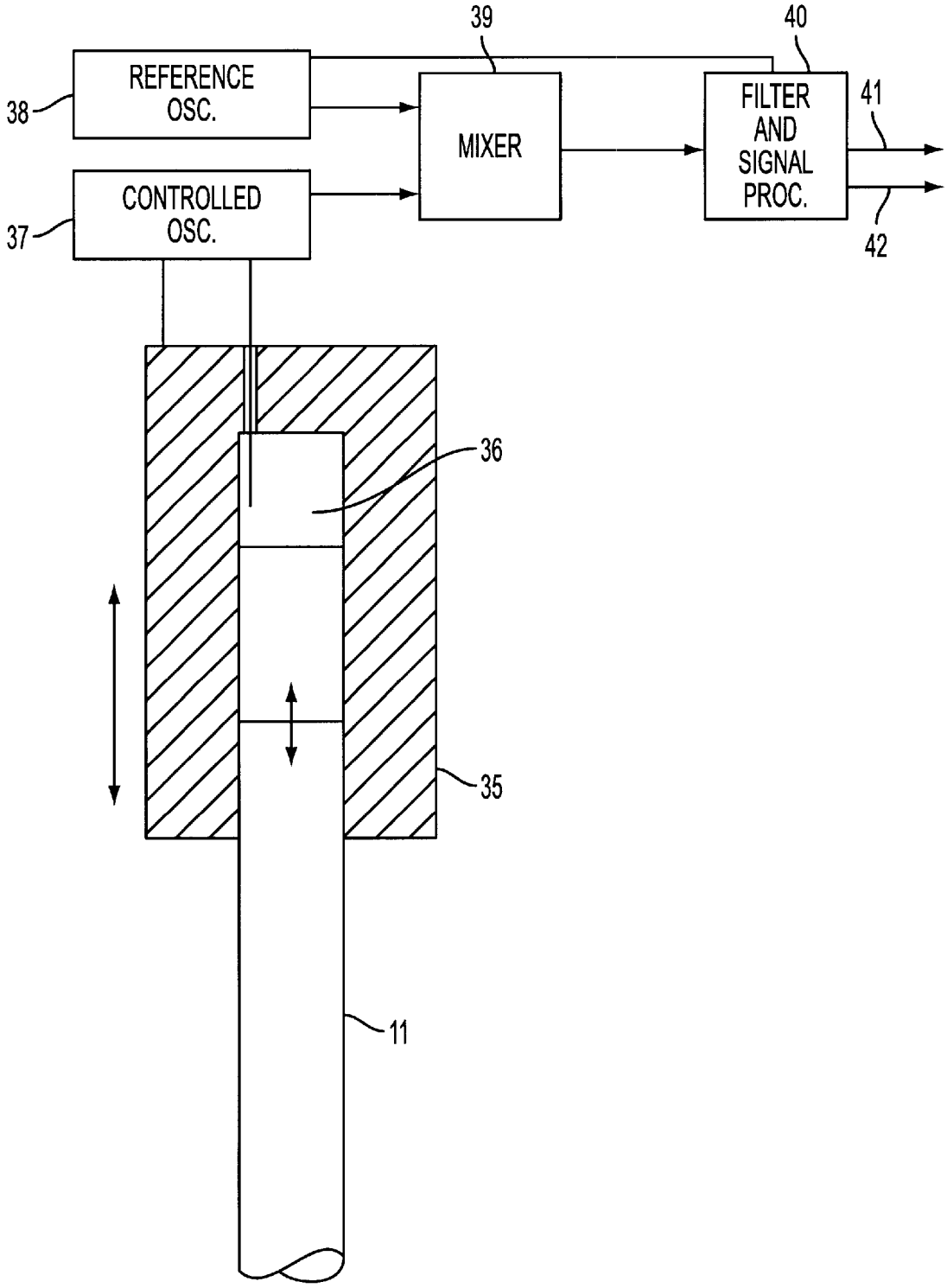
FIGS. 16 and 17 show embodiments of microwave resonator path sensors.
Figure 17:
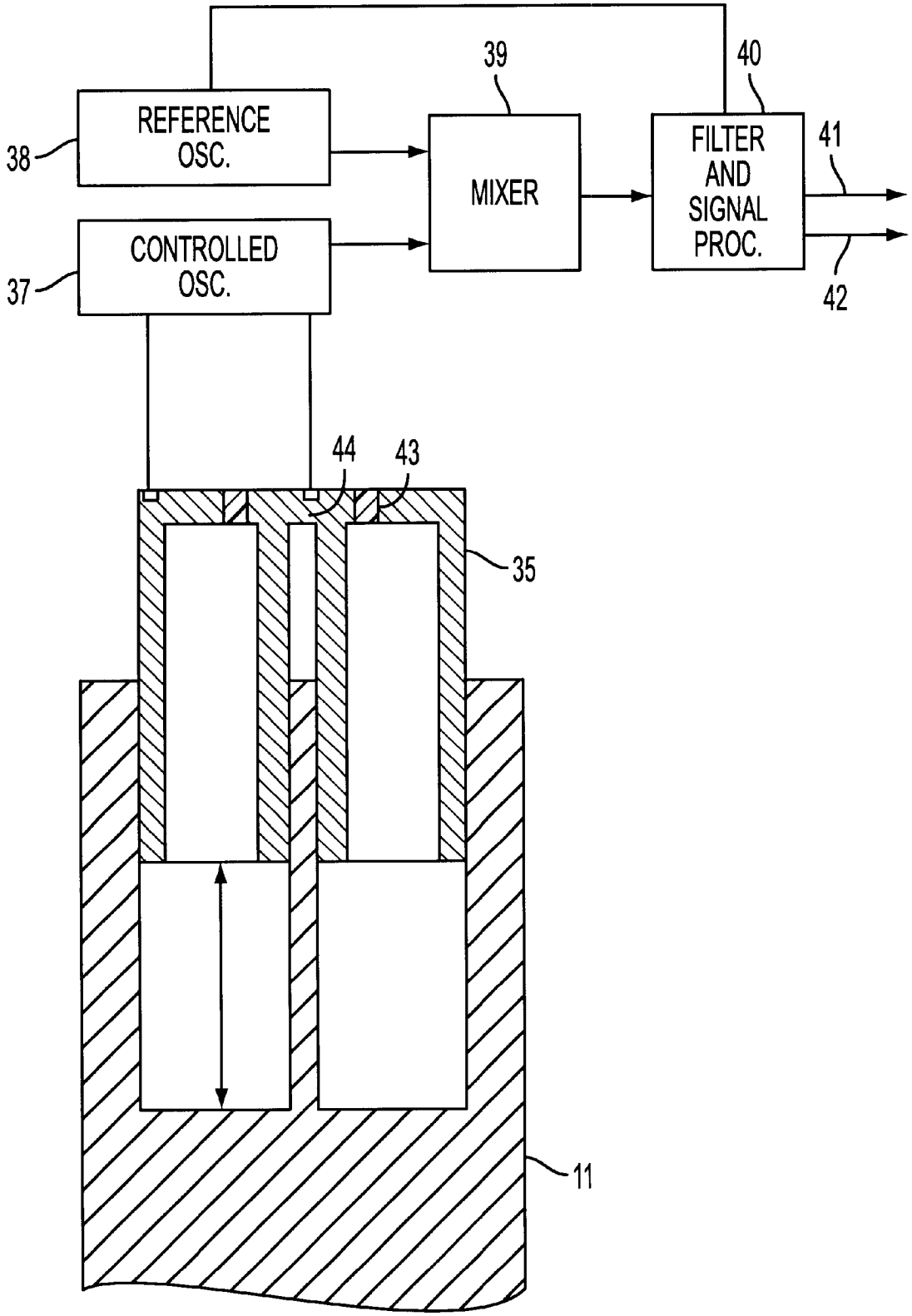
Figure 18:
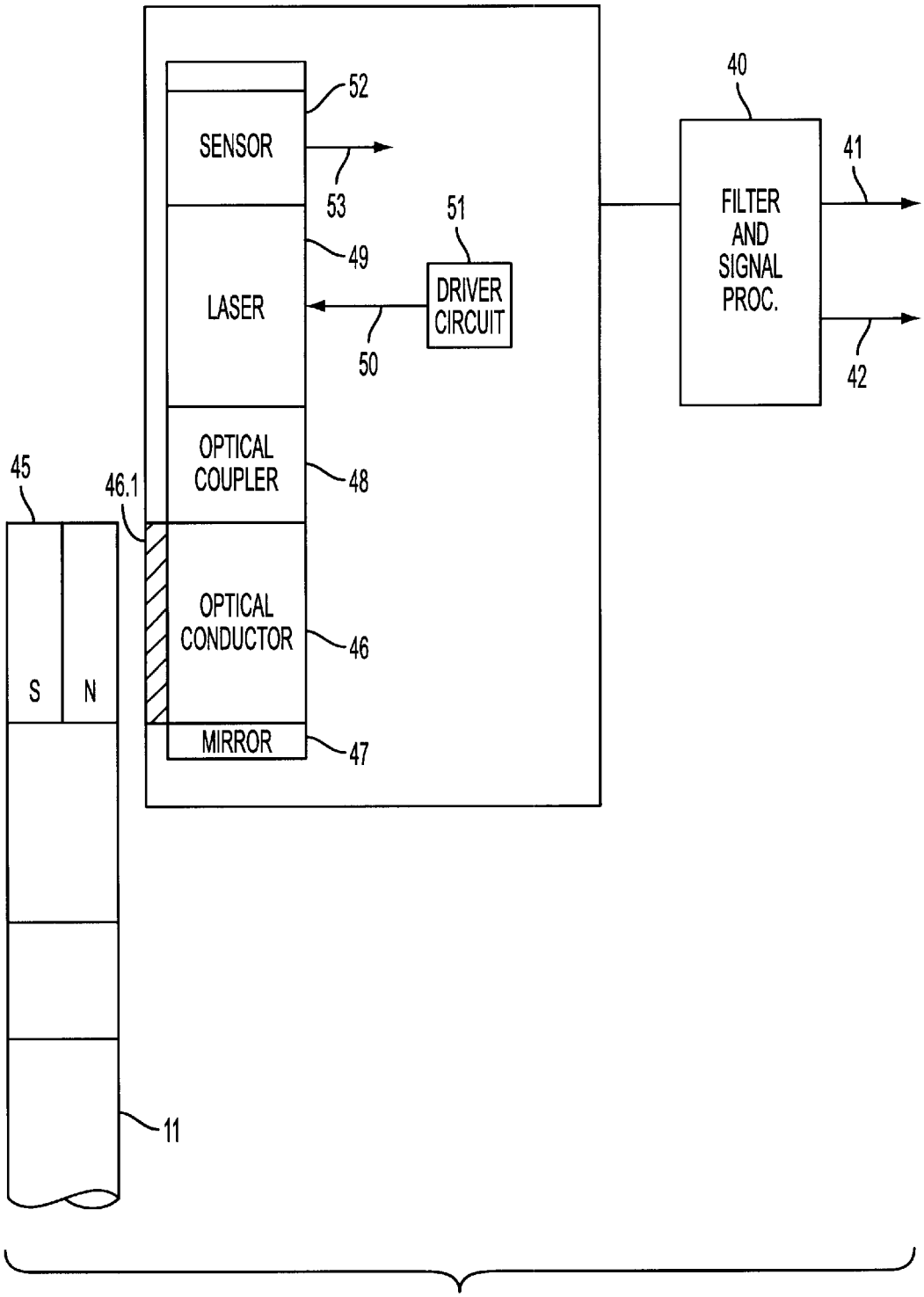
FIG. 18 shows an optical variant of a resonator path sensor.

FIGS. 16 to 18 show and describe measurements of the path and speed using a microwave resonator principle.

FIG. 16 shows an arrangement that can be fitted onto the top of an actuator. The valve shaft in that case is frictionally connected to the electromagnetic valve (EMV) armature and the guide rod 11, so that the guide rod 11 reflects the path position of the armature plate.

The free end of guide rod 11 projects into a resonator housing 35, which is filled in part with a dielectric 36, preferably in the areas that are not reached by the guide rod during the linear movement. An oscillator 37 is connected via a coupling device (capacitive or inductive) to the resonator. This arrangement makes it possible to use the path traveled by the armature as the frequency-determining component of an oscillator 37. The path signal information 41 as well as the speed information 42 can be made available to the engine control via a reference oscillator 38 in a mixer or a frequency demodulator 39 with subsequent filtering and signal processing 40.

FIG. 17 shows a comparable arrangement, which also can be fitted on top of an actuator. The guide rod 11 indicates the path position of the armature plate. The guide rod 11 forms a displaceable part of a coaxial resonator 35 with a fixed part that is filled with a dielectric. The guide rod 11 can travel the linear path and can thus change the reflection characteristics of such a coaxial resonator arrangement as function of the EMV armature movement.

By way of the insulation 43, the oscillator 37 is connected to the fixed resonator part between the center conductor 44 and the housing. A path signal 41 as well as the speed information 42 can be made available via a reference oscillator 38 in a mixer or a frequency demodulator 39, with subsequent filtering and signal processing.

A path or speed measurement obtained by using an optical resonator measuring principle is shown and described with the aid of FIG. 21.

FIG. 18 shows an arrangement in which an optical variant of a resonator measuring principle is illustrated, which can also be attached to the guide rod 11 of an actuator.

The guide rod 11 indicates the path position of the armature plate. In order to provide the armature position, a magnetic arrangement 45 that is connected to the shaft causes the effect of the magnetic field on the zone 46. The component 46 thus represents an optical conductor, for which the optical characteristics, preferably the refractive index, represent a function of the magnetic field intensity. The complete arrangement is screened against interfering fields and external fields.

The optical conductor 46 is sealed off on one side by an optical mirror 47 and is connected via coupling elements 48, for example a glass fiber and/or a polarization turning element and/or an optical impedance adaptation to semiconductor fibers, actuated via current signal 50 and driver 51. A semiconductor (HL) laser 49 transmits a beam in the direction of sensor 52. By way of the element 48, 46, 47, 46, 48, 49, the second beam of the HL laser 49 also impinges on this sensor, so as to interfere. The detector signal 53 thus measures the interference based on changes in the path length of the two beam paths. A path length is then changed implicitly by means of the magnetic field and the magnet 45 through varying the refractive index in the element 46, thus forming a measure for the path of the guide rod 11. A change in the length of element 46 when using optical materials, for which the refractive index is not a function of the magnetic field intensity, results from gluing together a magnetorestrictive material 46.1 and the optical element 46. Thus, the magnetic field effects a mechanical change in the length of element 46.

A path and speed signal is determined by evaluating the detector signal.

What is claimed is:

1. A method for actuating an electro-magnetic actuator for activating a cylinder valve provided with a valve stem in a piston-type internal combustion engine, with possible valve play between the valve stem and a guide rod for the actuator that acts upon the valve stem and is connected to an armature that is guided back and forth between pole faces of two electromagnets, arranged at a distance from each other, counter to the force of at least one restoring spring, wherein the current supply to the electromagnets is respectively controlled with the aid of a sensor arrangement and via an engine control unit, said method comprising: controlling the current such that the current supply to the electromagnet being approached by the armature so as to move the armature with a low movement speed toward the respective pole face, and, in order to regulate a valve play during the closing movement of the cylinder valve, further controlling the current supply to the electromagnet being approached such that initially the valve touches down softly on its seat and, following the valve play, the armature touches down softly on the respective pole face.

2. A method according to claim 1, wherein the current control is adjusted such that the armature maintains a predetermined path/speed profile in dependence on a detected position of at least one of the armature and the valve.

3. A method according to claim 1, wherein the current supply for the electomagnet being approached is switched to said further control and the armature is moved separately toward the pole face if a valve play exists when the valve touches down on the seat.

4. A method according to claim 3, further including recording the touchdown of the valve on the seat via a valve separation detector.

5. A method according to claim 1, wherein the control of the current supply to the electromagnet being approached for guiding the armature after the valve touches down on its seat, occurs during a specified interval, in dependence on the predetermined valve play.

6. A method according to claim 1, wherein the subsequent detection with sensors of at least one of the valve position and the armature position occurs via an electronic model of the actuator, which contains actuator parameters essential to the function.

7. A method according to claim 6, further including adding actual operating data from the engine control to improve the setting of parameters in the electronic model.

8. A method according to claim 1, further including checking the respectively initiated control measures via a pre-estimation unit containing an electronic model of the actuator to estimate their future effects, and correcting the controller control unit if necessary.

9. A method according to claim 1, further including determining the parameters correlated to the cylinder inside pressure at the start of the cylinder valve movement.

10. A method according to claim 1, further including: when switching off the voltage present at the electromagnet being approached, feeding energy back into the vehicle onboard system via a bridge circuit.

11. A method according to claim 1, further including during the valve opening in the first part of the opening phase, detecting the valve play via detection of a drop in speed when the armature impacts with the valve.

12. A method according to claim 1, including designing the spring mass system, consisting of the actuator, the readjustment spring and the cylinder valve, such that the distance between the earliest possible point for reaching the equalization of forces to the end position on the opening side and on the closing side is long enough to bridge the valve play and to balance sensor errors.

13. A method according to claim 1, including supplying the information concerning the cylinder valve movement, detected via the touchdown control, to the engine control unit.

14. A method according to claim 1, further including generating digital signals for detecting at least one of the path and the speed of the armature and making these digital signals available to the engine control unit.

15. A method according to claim 1, further including: in order to extend the distance traveled by the armature at low movement speed before reaching its end position, controlling the armature separation from the holding electromagnet by briefly supplying current to the holding electromagnet so that a lower maximum speed in the direction of the electromagnet being approached by the armature is achieved, and thus the earliest point at which a balance of forces can be reached is farther removed from the end position.

* * * * *